US010337232B2

(12) United States Patent
Fagersand et al.

(10) Patent No.: US 10,337,232 B2
(45) Date of Patent: Jul. 2, 2019

(54) METHOD FOR OPENING DOORS

(71) Applicant: STOPLIGHT AS, Oslo (NO)

(72) Inventors: Paul Nicholay Fagersand, Oslo (NO); Audun Olav Brandal, Oslo (NO)

(73) Assignee: STOPLIGHT AS, Oslo (NO)

( * ) Notice: Subject to any disclaimer, the term of this patent is extended or adjusted under 35 U.S.C. 154(b) by 0 days.

(21) Appl. No.: 14/773,154

(22) PCT Filed: Mar. 6, 2014

(86) PCT No.: PCT/IB2014/059491
§ 371 (c)(1),
(2) Date: Sep. 4, 2015

(87) PCT Pub. No.: WO2014/136077
PCT Pub. Date: Sep. 12, 2014

(65) Prior Publication Data

US 2016/0010383 A1 Jan. 14, 2016

(30) Foreign Application Priority Data

Mar. 7, 2013 (NO) ..... 20130351

(51) Int. Cl.
*E05F 15/73* (2015.01)
*E05F 15/78* (2015.01)
*E05F 15/79* (2015.01)

(52) U.S. Cl.
CPC ..... *E05F 15/73* (2015.01); *E05F 15/78* (2015.01); *E05F 15/79* (2015.01); *E05Y 2400/44* (2013.01); *E05Y 2400/82* (2013.01); *E05Y 2400/852* (2013.01); *E05Y 2400/858* (2013.01); *E05Y 2400/86* (2013.01); *E05Y 2800/00* (2013.01); *E05Y 2800/106* (2013.01)

(58) Field of Classification Search
CPC .... E05B 53/001; E05B 1/0053; E05B 1/0069; E05F 15/73; E05F 15/74; E05F 15/78; E05Y 2400/858; E05Y 2400/86
See application file for complete search history.

(56) References Cited

U.S. PATENT DOCUMENTS 2,341,546 A * 2/1944 Hagenbook ..... E05F 15/74 362/272
2,946,931 A * 7/1960 Durbin ..... E05F 15/74 250/210
3,036,256 A * 5/1962 Purdy ..... E05F 15/78 250/237 R (Continued)

FOREIGN PATENT DOCUMENTS

DK 1470314 T3 7/2006
JP 2010-281175 A 12/2010

OTHER PUBLICATIONS

International Search Report issued in PCT/IB2014/059491, dated May 20, 2014 (3 pages).

(Continued)

*Primary Examiner* — Catherine A Kelly
(74) *Attorney, Agent, or Firm* — Osha Liang LLP

(57) ABSTRACT

A method and device for opening a door in a hygienic manner, is done by positioning a foot or hand in a specific defined area so that a light beam that is directed towards the area is interrupted within a set range of distances such that an automatic opening mechanism for the door is activated.

10 Claims, 2 Drawing Sheets

(56) References Cited

U.S. PATENT DOCUMENTS

| | | | | |
|---|---|---|---|---|
| 4,614,057 | A | 9/1986 | Sorber | |
| 5,048,150 | A * | 9/1991 | Guerin | E05C 17/20 16/49 |
| 5,410,149 | A | 4/1995 | Winston, Jr. et al. | |
| 5,636,477 | A | 6/1997 | Hulse et al. | |
| 6,967,587 | B2 * | 11/2005 | Snell | E05F 15/00 340/686.6 |
| 7,032,348 | B1 * | 4/2006 | Epps | E05F 15/74 49/25 |
| 7,084,388 | B2 | 8/2006 | Rejc | |
| 7,184,047 | B1 * | 2/2007 | Crampton | G06T 17/00 345/473 |
| 7,446,862 | B2 | 11/2008 | Zambon | |
| 8,091,280 | B2 * | 1/2012 | Hanzel | B60R 25/2054 296/146.4 |
| 8,284,018 | B2 * | 10/2012 | Ibsies | E05F 15/74 340/3.1 |
| 9,002,589 | B2 * | 4/2015 | Reime | G01V 8/20 296/146.4 |
| 2008/0007710 | A1 | 1/2008 | Zambon | |
| 2008/0296926 | A1 | 12/2008 | Hanzel et al. | |
| 2009/0265990 | A1 * | 10/2009 | Stratmann | A47K 5/12 49/31 |
| 2011/0056134 | A1 | 3/2011 | Zacchio et al. | |
| 2012/0127317 | A1 | 5/2012 | Yantek et al. | |
| 2013/0293245 | A1 * | 11/2013 | Kuhnen | E05B 83/18 324/658 |
| 2014/0085093 | A1 * | 3/2014 | Mittleman | H04L 12/282 340/628 |
| 2014/0173986 | A1 * | 6/2014 | Van Gastel | B60R 19/483 49/31 |
| 2015/0259966 | A1 * | 9/2015 | Sakai | E05F 15/73 49/31 |

OTHER PUBLICATIONS

Written Opinion issued in PCT/IB2014/059491, dated May 20, 2014 (4 pages).

International Preliminary Report on Patentability issued in PCT/IB2014/059491, dated May 4, 2015 (8 pages).

Norwegian Search Report dated Sep. 25, 2013, issued in Norwegian Patent Application No. 20130351, which corresponds to PCT/IB2014/059491 (4 pages).

* cited by examiner

METHOD FOR OPENING DOORS

INTRODUCTION

The present invention relates to a method and device for opening a door. More specifically, a hygienic manner of opening a door is described.

BACKGROUND FOR THE INVENTION

Doors are found everywhere for opening and closing access between two rooms or zones. Most doors are opened manually by operating a closing mechanism and/or by pushing the door open using a hand or foot. There may also be different types of switches that are operated to activate a mechanism for opening a door.

It is well known that infection spreads via door handles or door-opening switches. In different institutions, and especially in hospitals, it is very important that infection is prevented to the greatest possible extent.

In such locations therefore, in connection with opening, doors, motion detectors are often installed, which, on detection of motion in an area in front of a door, activate an opening mechanism. However, it is not always desirable that a door opens whenever a person passes in front of it without intentionally wanting to open it.

There are therefore different types of alternative door switches that can intentionally be used without having to use the palm of the hand. An example of such a switch is an oblong, narrow switch that is typically positioned on the wall at the side of a door that is to be opened, which switch is intended to be operated by using an elbow. Such switches are found, inter alia, in many hospitals today.

However, this is a relatively awkward way of opening a door and is often used incorrectly in that the palm of the hand is used to operate the switch, thereby allowing infection to spread.

The object of the present invention is to provide a new method and device for opening a door in a hygienic manner.

BRIEF DESCRIPTION OF THE INVENTION

The present invention is described by a method for opening a door in a hygienic manner, this being done by directing a light beam from a device contained within a door switch towards a specific defined area; detecting whether the light beam is interrupted and also where in the path of the light beam it is interrupted, and activating an opening mechanism for the door when the light beam is interrupted within a set range of distances along the path of the beam.

Additional features of the invention are described in the dependent claims of the set of claims.

The invention is also described by a door switch for opening a door in a hygienic manner, the switch comprising a device for emitting a light beam that is directed towards a specific defined area, and where the door switch further comprises detection means for detecting whether the light beam is interrupted and where in its path the light beam is interrupted, and activating means for sending activating signals to an opening mechanism for the door when the light beam is interrupted within a set range of distances along the path of the beam.

Additional features of the door switch are described in the dependent claims.

DETAILED DESCRIPTION

The invention will now be described in more detail with reference to the figures and to examples of implementation.

As mentioned, the invention is described by a method for opening a door in a hygienic manner. This is done by positioning a foot or hand in a specific defined area so that a light beam directed towards the area is interrupted and an automatic opening mechanism for the door is activated.

Figure 1:
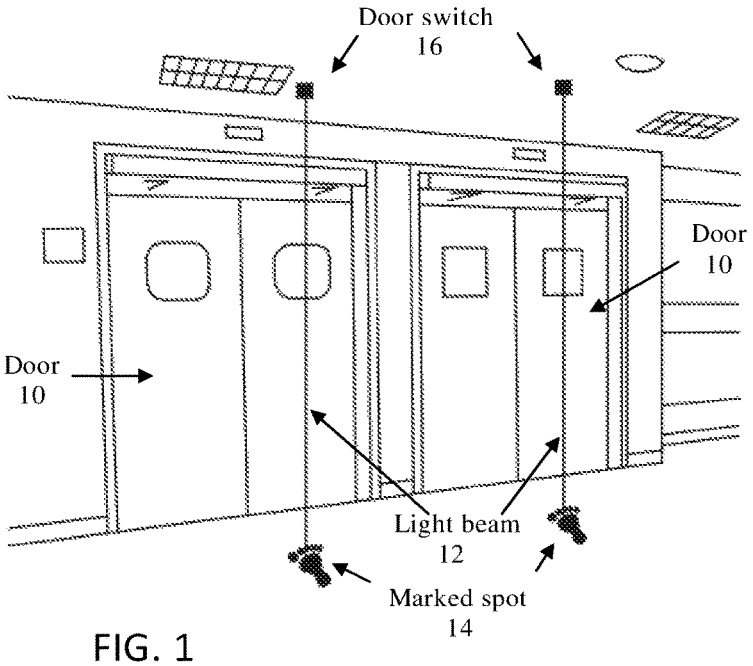
FIG. 1 shows one implementation of a door switch according to the invention.

FIG. 1 shows an embodiment of the invention with the said specific defined area marked on a floor in proximity to doors 10 that are to be opened, and where a foot is placed on the marked spot 14 in order to open the door 10. The light beam 12 is directed towards the marked spot 14.

In order for a foot to activate the opening mechanism for a door 10, the foot must be placed on the marked spot 14. It is only when the beam is interrupted at a predetermined distance within a set range of distances along the path of the beam from the device emitting the beam that activation will take place. Activation will not take place if the foot interrupts the beam in an area outside the said range.

The advantage of activating the opening mechanism by interrupting the light beam 12 only within a range of distances is that the door 10 will only be opened by an intentional and desired action in that a person must place his foot in the exact location of the marked spot 14.

If a person passes through the light beam 12 such that, for example, his head or shoulder interrupts the beam 12, the opening mechanism will not be activated since the light beam 12 has not been interrupted within the set range of distances.

If the floor on which the marked spot 14 is located is to be washed, it will be possible to do so without activating the opening mechanism. If, e.g., a mop is passed over the spot, this will not activate the opening mechanism since the mop will be able to pass below a predetermined range of distances that define trigger points, i.e., the distance along the path of the beam from the device emitting the beam.

In an embodiment of the invention, the light beam 12 must be interrupted at said predetermined distance for a given length of time before activation of an automatic opening mechanism will take place.

In another embodiment, time-limited access to a room or zone may be set so that activation of the opening mechanism will only take place within set time intervals.

The marked spot 14 may in an embodiment represent a print of a foot. In other embodiments it may represent other symbols to indicate where a foot should be placed in order to open a door 10. The marked spot 14 may also be configured as a raised area so as to allow the location of the spot to be felt.

In one implementation of the invention where a door 10 is to be opened by placing a foot on a marked spot 14, the specific defined area may be next to or in proximity to the wall 18 in which the door 10 is placed. A solution of this kind means that the said light beam 12 that is interrupted will be emitted from a device that has been installed where an earlier mechanical operating switch for the door 10 was located.

Figure 2:
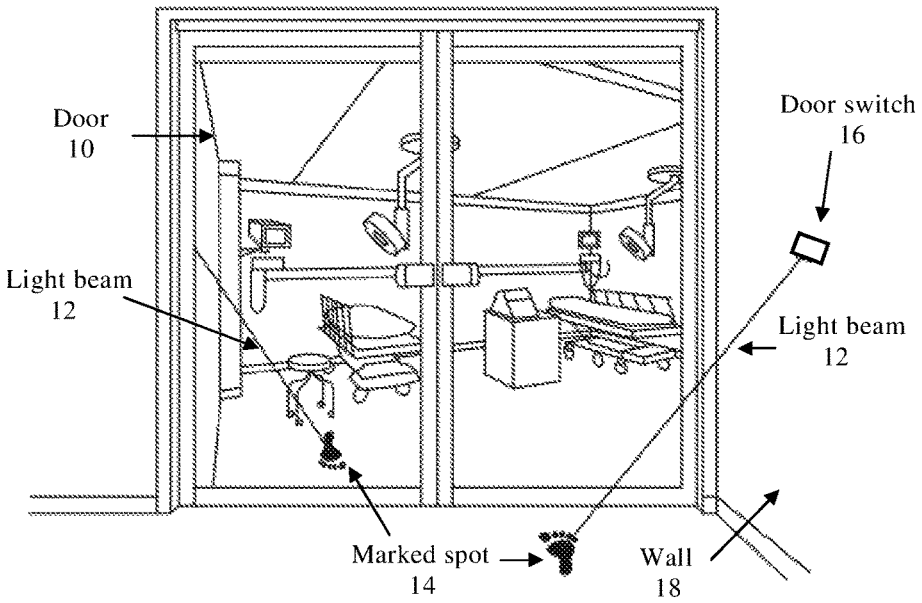
FIG. 2 shows another implementation of a door switch according to the invention.

FIG. 2 shows an example of this where a light beam 12 from a door switch 16 is directed towards a specific defined area on the floor, which area is marked by a footprint. A person who is to open the door 10 then puts his foot on a marked spot 14 on the floor towards which the light beam 12 is directed, so that the light beam 12 is interrupted at a set distance and an opening mechanism for the door 10 is activated.

In a typical implementation of the invention, the said area is in a natural walking zone, e.g., 1 to 3 meters from the door 10 to be opened. A person walking towards the door 10 will then easily be able to adapt his stride to strike the marked spot 14 with his foot, and quickly and efficiently initiate opening of the door 10.

In another embodiment of the invention, the said specific area is a marked spot 14 in a ceiling in proximity to the door 10 to be opened, and where a hand must be moved above head height towards the marked spot 14 in order to open the door 10.

The marked spot 14 may in an embodiment represent a print of a hand. In other embodiments it may represent other symbols to indicate where a hand is to be positioned or directed towards the marked spot 14 in order to open a door 10.

In an implementation of the invention where a door 10 is to be opened by moving a hand towards a marked spot 14, the specific defined area may be next to or in proximity to the wall 18 in which the door 10 is located. A solution of the kind means that the said light beam 12 that is interrupted may exit from a device that is located, for example, at a height on the wall 18 above normal head height for an adult person. A person who is to open the door 10 raises his hand towards a marked spot 14 in the ceiling, such that the light beam 12 is interrupted at a given height, and an opening mechanism is activated.

The invention can also be used to replace door latches on ordinary door leaves. In an implementation of this kind, the marked spot 14 may be right by the door leaf on the side of the door 10 that does not face into the room. When a person puts his foot on the marked spot 14, this will initiate opening of the door 10 in that the door latch has an automatic mechanism that opens it, and the door 10 is opened in that the door leaf itself is pushed open by means of an automated opening mechanism.

Figure 3:
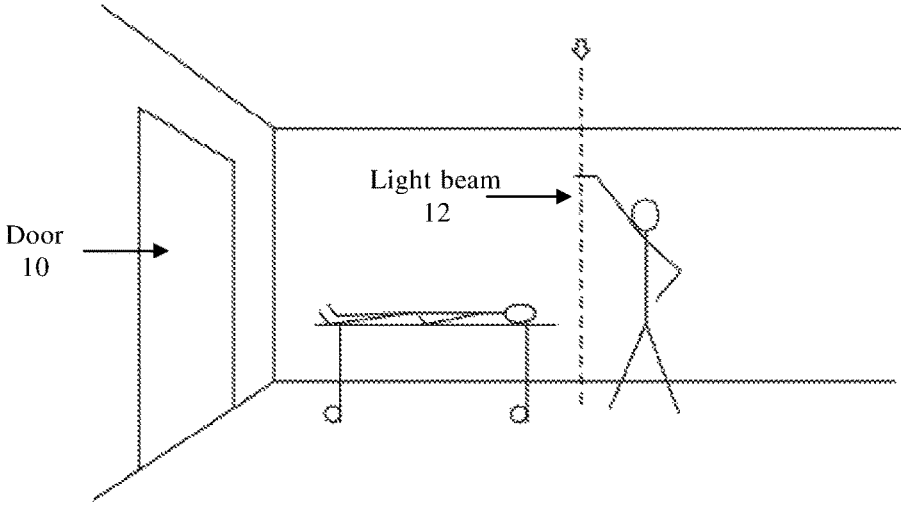
FIG. 3 shows yet another implementation of a door switch according to the invention.

FIG. 3 shows another implementation of the invention where the said area is in a natural walking zone 2 to 5 meters from the door 10 to be opened. A person wheeling, for example, a bed in front of him and walking towards the door 10 will then easily be able to raise his hand towards a marked spot 14 in the ceiling for quick and efficient opening of the door 10 before the bed reaches it. When the hand interrupts the beam within a set distance range from the device from which the beam is emitted, the opening mechanism will be activated. The solid line in the light beam 12 path where the hand strikes indicates the distance at which activation will take place when the light beam 12 is interrupted.

The present invention also comprises a door switch 16 with activating means in order to open a door 10 in a hygienic manner. The door switch 16 comprises transmitter means for emitting a narrow light beam 12 that is directed towards a specific defined area, detection means for detecting that the light beam 12 is interrupted at a set distance from the device, and activating means for sending activating signals to an automatic opening mechanism for the door 10.

The means for transmitting the narrow light beam 12 can in an embodiment of the door switch 16 be incorporated in art adjustable holder such that the angle at which the light beam 12 exits the door switch 16 can be changed.

This will be a suitable solution when the door switch 16 according to the invention is implemented as shown in FIG. 2. The figure shows a door switch 16 according to the invention that is mounted in order to replace a conventional mechanical switch on the wall 18.

After mounting the door switch 16 on the wall 18, the beam 12 can be directed against a selected defined area on the floor.

In an embodiment of the door switch 16, it comprises calculating means for determining the distance to the floor that the emitted beam strikes, and also a range of distances over this distance corresponding to the height of a foot, e.g., 3-9 cm above the floor. In such an embodiment of the door switch 16, it will be automatically set and calibrated in accordance with a desired range that activates the door switch 16 when the light beam 12 is interrupted.

The light beam 12 used in the invention may be a laser beam. It may also be another type of focused light, for example, infrared light (IR) or light from LED. ER can also be combined with use of ultrasound to improve the accuracy of the distance measurement. A light generating device that is implemented in a device according to the invention also comprises detection means for detecting a change in the light beam 12, for example, interruption thereof or phase difference when using laser. The devices including the detection means are connected to an automated opening mechanism for a door.

It should be understood that different types of doors can be opened using the invention. These include hinged doors, sliding doors and swing doors. The invention is not limited to use in hospitals, but can advantageously be used in, e.g., factories, garages etc.

The invention solves a problem that is associated with the fact that doors that are intended to be opened in a hygienic manner, by the use of an elbow on a switch, are not used as intended, such that infection is nevertheless spread via such switches for doors. It is furthermore not always desirable to have doors that open automatically based on motion detectors in proximity to a door. Such solutions often open a door even though this was not the intention.

The present invention solves these problems in that a door can be opened by interrupting a beam within a set range of distances along the path of the beam.

The invention claimed is:

1. A method for opening a door in a hygienic manner, comprising:

emitting and directing a single light beam from a device contained in a door switch towards a specific defined area on a floor;

placing a foot on the defined area which is a marked spot on the floor in the proximity to a door to be opened;

detecting whether the single light beam is interrupted and also a distance from the device emitting the light beam to where in a path of the single light beam the interruption occurred; and activating an opening mechanism for the door when the distance is within a set range of distances corresponding only to a particular distance above the marked spot along the path of the single light beam.

2. The method according to claim 1, wherein in the activating step, the opening mechanism for the door is activated when the single light beam is interrupted for a given length of time, and within the set range of distances along the path of the single light beam.

3. The method according to claim 1, wherein the marked spot on the floor is configured as a print of a foot.

4. The method according to claim 1, wherein the marked spot on the floor is placed next to a wall in proximity of a door that is to be opened.

5. The method according to claim 1, wherein the marked spot on the floor is placed in a natural walking zone 1 to 3 meters from the door to be opened.

6. The method of claim 1, wherein the marked spot on the floor is raised so that the marked spot on the floor can be felt.

7. A method for opening a door in a hygienic manner, comprising:

emitting and directing a single light beam from a device contained in a door switch towards a specific defined area on a ceiling;

moving a hand above head height towards the defined area which is a marked spot on the ceiling in the proximity to a door to be opened;

detecting whether the single light beam is interrupted and also a distance from the device emitting the light beam to where in a path of the single light beam the interruption occurred; and activating an opening mechanism for the door when the distance is within a set range of distances corresponding only to a particular distance below the marked spot along the path of the single light beam.

8. The method according to claim 7, wherein the marked spot on the ceiling is configured as a print of a hand.

9. The method according to claim 7, wherein the marked spot on the ceiling is placed next to a wall of the door that is to be opened.

10. The method according to claim 7, wherein the marked spot on the ceiling is placed in a natural walking zone 2 to 5 meters from the door to be opened.

* * * * *